United States Patent [19]

Sundström

[11] Patent Number: 4,896,575

[45] Date of Patent: Jan. 30, 1990

[54] SAWCHAIN

[75] Inventor: Erik Sundström, Sandviken, Sweden

[73] Assignee: Sandvik AB, Sandviken, Sweden

[21] Appl. No.: 357,900

[22] Filed: May 25, 1989

[51] Int. Cl.[4] ..... B27B 33/14

[52] U.S. Cl. ..... 83/833; 83/174; 83/830

[58] Field of Search ..... 83/831, 832, 833, 834, 83/830, 174; 30/138

[56] References Cited

U.S. PATENT DOCUMENTS

| | | | |
|---|---|---|---|
| 3,170,497 | 2/1965 | Ehlen et al. | 83/833 |
| 3,189,064 | 6/1965 | Frederickson | 83/834 |
| 3,601,167 | 8/1971 | Dolata | 83/830 |
| 3,921,490 | 11/1975 | Dolata et al. | 83/833 |
| 4,535,667 | 8/1985 | Gibson et al. | 83/830 |

*Primary Examiner*—Donald R. Schran

*Attorney, Agent, or Firm*—Burns, Doane, Swecker & Mathis

[57] ABSTRACT

A sawchain designed for resharpening while it is idling around the drive sprocket has cutting links (16) on the left and right sides with depth gauges (10) and spade-shaped cutters (22) which between their front (12) and rear borders (14) have a fold (13) substantially perpendicular to the lengthwise direction of the sawchain with the concave side outwards away from the central plane, permitting the rear border (14) and the side edge (12) to contact the side walls of the kerf. The depth gauge (10) is placed so far forward on the cutter links (16) that the chip thickness (19) is sufficient when the sawchain is straight. The intermediate drivelinks (21) may be provided with raker teeth (17) located so far to the rear that they do not touch the bottom of the kerf when the chain is straight, but only loosen and convey the chips cut by the cutters (22) of the cutter links (16).

5 Claims, 1 Drawing Sheet

Fig. 1
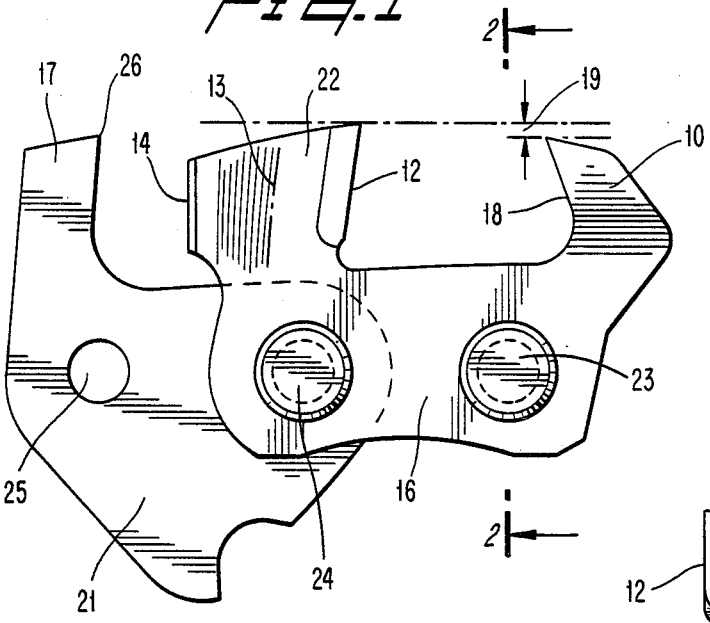
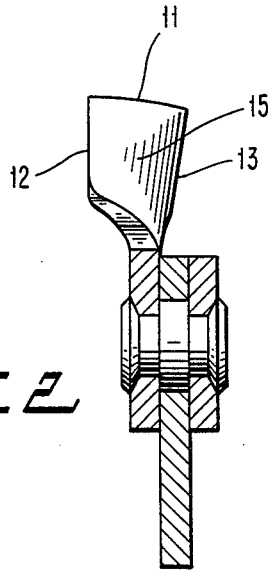
Fig. 2
Fig. 3
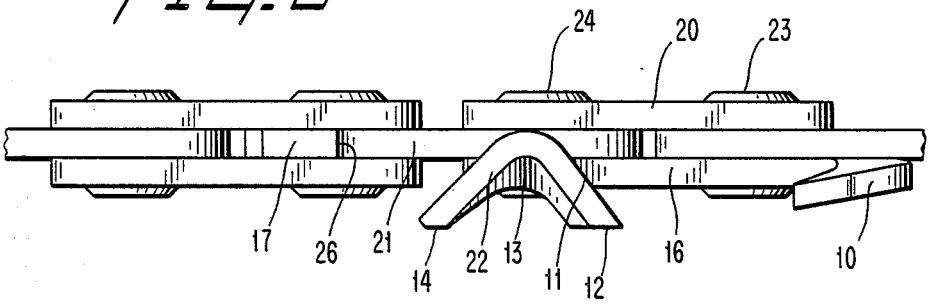

SAWCHAIN

BACKGROUND

It has been long known that sawchains can be designed to be sharpened by application of a shaped block of abrasive material against the top of the chain when it runs idling around the drive sprocket of the chain saw. Such devices save time, because the chain needs not be removed, and no filing gauge has to be mounted on the guidebar. It is also simpler for unexperienced users, since no knowledge of filing angles is needed.

In spite of this such sawchains have only found limited use, since they have severe drawbacks in other respects.

They all have in common that the height of the cutter links decreases quickly, and no more than 6 to 8 resharpenings can be made before the sawchain must be discarded, because every resharpening removes a layer corresponding to the radius of the worn edge, circa 0.25 mm. This compares with 20 to 25 resharpenings in the lengthwise direction for a conventional sawchain. There are, however, certain applications such as for temporary use, for use as a hobby tool and for use in vehicle-born harvesters and fellers, when the number of resharpenings possible is unimportant compared to the speed and convenience in resharpening.

The present invention concerns a sawchain which can be resharpened by grinding the tops of the cutter links, without the drawbacks that until now have prevented a more common use of prior top-sharpened sawchains.

PRIOR ART

The U.S. Pat. Nos. 3,170,497 and 3,601,167 describe sawchains where the transversal edge and the side edge are created by grinding the front face of a conspicuously thickened part of the link. Such a thickening is expensive and difficult to produce, and requires either removing lots of material or a much more severe upsetting deformation than those hard materials can withstand, which are suitable for edge sharpness. They also require maintaining the side edge by occasional hand filing.

The U.S. Pat. No. 3,189,064 describes a sawchain where the transversal edge is formed on the cutter at the border of a part which has been folded along a sloping line to be roughly perpendicular to that part of the cutter where the side edge is formed. The side edge must have a long clearance face with small clearance angle to avoid being laterally self-feeding, and must be maintained by hand filing. Certain related designs have complicated side edges divided into several sections with different slopes, but are inefficient if this hand filing is not correctly made.

It is known from the U.S. Pat. No. 3,921,490 to make sawchains where the transversal edge as well as the side edge are formed by grinding the borders of a flat spade-shaped part of the cutter link. This chain design has the disadvantage that the spade-shaped part is easily bent upwards or sideways when sawing into mineral particles or hard knots in the wood, whereupon the sawchain is likely to get stuck in the kerf or to damage the grinding device.

It is further known through the U.S. Pat. No. 4,535,667 to design sawchains where the spade-shaped part of the cutter link is stiffened by a sloping fold with the concave side inwards and downwards. The spade-shaped part is then strong enough not to be deformed by sawing into hard items, but this requires complicated depth gauges, sideways as well, and the flow of chips is so obstructed that the space between the spade-shaped part and the drivelinks is soon clogged by chips and pitch.

DESCRIPTION OF THE INVENTION

The invention is described with reference to the figures, where:

FIG. 1 shows a cutter link and the drivelink following,

FIG. 2 shows a cross section through the chain in front of the cutter on the cutter link at the line "S" of FIG. 1, and FIG. 3 shows a length of the chain viewed from above.

A sawchain according to the invention comprises drivelinks (21), sidelinks (20) and cutter links (16). A cutter link (16) in a chain according to the invention has a flat lower part with rivet holes (23 and 24). From this a depth gauge (10) of conventional type rises, preferably slightly bent outwards and extended forwards to expose a larger contact surface towards the wood as is described in U.S. Pat. No. 3.548.897, which is incorporated is this description, and a cutter (22) of wholly new type. This is substantially spade-shaped with a substantially vertical fold (13) with its concave side outwards away from the center plane. The cutter (22) is formed with a transversal edge (11) and a side edge (12) which can be automatically resharpened. A vertical fold (13) gives the cutter (22) a very large resistance to impacts in the lengthwise direction of the sawchain, and also permits the rear border (14) of the cutter to eliminate the sideways self-feeding tendency in the same way as the small clearance angle in the sawchain according to U.S. Pat. No. 3,189,064 or the elongated depth gauge according to U.S. Pat. No. 4,625,610, but does it with less friction. The chip flow will be advantageous because the rake surface (15) adjacent to the edges (11 and 12) can be made flat or slightly concave.

The sawchain has cutter links alternatingly on the right and left side, and can also as is previously known be provided with raker teeth (17) at the rear end of those drivelinks (21) following behind the cutter links (16). The raker teeth (17) are flat and have their edge (26) and rake face perpendicular to the plane of the drivelink. If raker teeth (17) are provided, the transversal edges (11) on the cutter links (16) can be made shorter, which lowers the cutting forces and allows a freer flow of chips.

To give the desired chip thickness (19) and cutting speed, the transversal edge (11) skould be placed farther forward than the axis of the rear rivet (24), and the highest point of the depth gauge (10) above or farther forward than the axis of the front rivet (23). To produce the same chip thickness (19) even after a number of resharpenings, the rear face (18) of the depth gauge (10) must turn forward.

I claim:

1. Sawchain comprising drivelinks, sidelinks and cutter links, with cutter links on both the left and right side of the sawchain, and where each cutter link consists of a flat lower part, from which one depth gauge and one cutter rise, both of which are designed for automatic resharpening by an abrasive tool mounted on the motor unit powering the sawchain, characterized by the front border of the cutter with the side edge and the rear border of the cutter being located on the same side farther away from the central plane of the sawchain than the outer surface of the lower flat part of the cutter link, and by having a fold intermediate between the front border of the cutter with the side edge and the rear border, where the middle part of the cutter adjacent to said fold lies closer to the central plane of the sawchain than said surface of the lower flat part of the cutter link.

2. Sawchain according to claim 1, characterized by the fold being substantially perpendicular to the longitudinal direction of the sawchain.

3. Sawchain according to claim 1, characterized by some drivelinks being provided with raker teeth.

4. Sawchain according to claim 3, characterized by the raker teeth extending farther rearwards than the axis of the rear rivet hole.

5. Sawchain according to claim 2, characterized by some drivelinks being provided with raker teeth.

* * * * *